US012279728B1

(12) United States Patent
Liu et al.

(10) Patent No.: US 12,279,728 B1
(45) Date of Patent: Apr. 22, 2025

(54) BATHTUB FUNCTIONAL PAD

(71) Applicant: WELLFINE SILICONE PRODUCTS CO., LTD., Guangdong (CN)

(72) Inventors: Feng Liu, Guangdong (CN); Junxuan Fan, Guangdong (CN)

(73) Assignee: WELLFINE SILICONE PRODUCTS CO., LTD., Dongguan (CN)

( * ) Notice: Subject to any disclaimer, the term of this patent is extended or adjusted under 35 U.S.C. 154(b) by 0 days.

(21) Appl. No.: 18/918,202

(22) Filed: Oct. 17, 2024

(30) Foreign Application Priority Data

Jan. 17, 2024 (CN) ..... 202420118852.X

(51) Int. Cl.
*A47K 3/30* (2006.01)
*A47K 3/28* (2006.01)

(52) U.S. Cl.
CPC ..... *A47K 3/302* (2013.01); *A47K 3/281* (2013.01)

(58) Field of Classification Search
CPC ..... A47K 3/302
USPC ..... 4/559, 609
See application file for complete search history.

(56) References Cited

U.S. PATENT DOCUMENTS

| | | | | |
|---|---|---|---|---|
| 5,381,564 A * | 1/1995 | Carroll | A47K 3/004 4/559 |
| 5,551,101 A * | 9/1996 | Leach | A47K 3/002 4/571.1 |
| 9,238,907 B2 * | 1/2016 | Murray | E03C 1/181 |
| 11,375,858 B1 * | 7/2022 | Stander | A47K 3/302 |
| 2014/0157501 A1 * | 6/2014 | D'Amico | E03D 13/005 4/256.1 |

* cited by examiner

*Primary Examiner* — Lauren A Crane
(74) *Attorney, Agent, or Firm* — Daniel M. Cohn

(57) ABSTRACT

The present disclosure relates to a bathtub functional pad including a main body that can be bent and deformed. A baffle is arranged in a middle of an upper surface of the main body, a bottom of the baffle connected to the main body, a top of the baffle extending upwardly along a direction away from the main body, and at least one receiving bag with a mouth arranged on the main body. The functional pad can be used in conjunction with a bathtub, and the at least one receiving bag can configured to place such as toys and toiletries, so as to be conveniently taken. The baffle can effectively prevent water from splashing out of the bathtub to reduce risks of parents' clothes getting wet.

10 Claims, 2 Drawing Sheets

BATHTUB FUNCTIONAL PAD

BACKGROUND

1. Technical Field

The present disclosure generally relates to the field of articles for daily usage, and especially relates to a functional pad used in conjunction with a bathtub.

2. Description of Related Art

Nowadays, many families have bathtubs in their bathrooms, and children very like to bring some toys when taking a bath in the bathtub. However, a storage space in a general bathroom is limited, if collecting the toys in a bathroom cabinet is also very cumbersome, and the toys with water in the cabinet are prone to mold growth. In addition to toys, it is also suitable to place bathing articles nearby for easy access when taking a bath in the bathtub. Therefore, there is still a room for improvement in terms of bathtub usage.

SUMMARY

The technical problems to be solved: in view of the shortcomings of the related art, the present disclosure provides a functional pad used in conjunction with a bathtub, which can be used to place articles needed for bathing.

The technical solution adopted for solving technical problems of the present disclosure is: a bathtub functional pad according to an embodiment of the present disclosure includes a main body that can be bent and deformed, a baffle arranged in a middle of an upper surface of the main body, a bottom of the baffle connected to the main body, a top of the baffle extending upwardly along a direction away from the main body, and at least one receiving bag with a mouth arranged on the main body.

Wherein two ends of the baffle are bent and extend forward to respectively form a wing portion thereof.

Wherein each of the main body and the baffle is made of silica gel.

Wherein an interior of the baffle is hollowed to form a chamber thereof, and an opening is formed in the middle of a lower surface of the main body to connect with the chamber.

Wherein a plurality of reinforcing ribs is distributed in the chamber and supported between a front wall and a back wall of the chamber.

Wherein a plurality of sucking discs is arranged on a lower surface of the main body.

Wherein the at least one receiving bags that is arranged on the main body includes two receiving bags, the two receiving bags respectively arranged at a front portion and a back portion of the upper surface of the main body.

Wherein a grid layer is formed on each of the front portion and the back portion of the upper surface of the main body to form the receiving bag; a cloth belt covered on a peripheral edge of the main body, and the grid layer fixedly connected to the cloth belt.

Wherein the at least one receiving bag is divided into a plurality of individual pouches.

Wherein a foldable portion is arranged on each of a front side and a rear side of the baffle to reduce a resistance when the front portion and the back portion of the main body are bent.

The present disclosure provides the advantages as below: when the present disclosure is in usage, the functional pad can be hung on an edge of the bathtub. The middle of the functional pad is in contact with the top of the bathtub edge, so that the front portion and the back portion of the functional pad are respectively hung on an inside and an outside of the bathtub. Bath articles, toys and the like can be placed in the receiving bag for easy access during bathing in the bathtub. When parents sit outside the bathtub to shower their children, the baffle in the middle of the functional pad can prevent water in the bathtub from splashing out to wet the parents.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. The same reference numerals in the accompanying drawings indicate the same or similar components or parts, one of ordinary skill in the related art should understand that these drawings are not necessarily drawn to scale.

Figure 1:
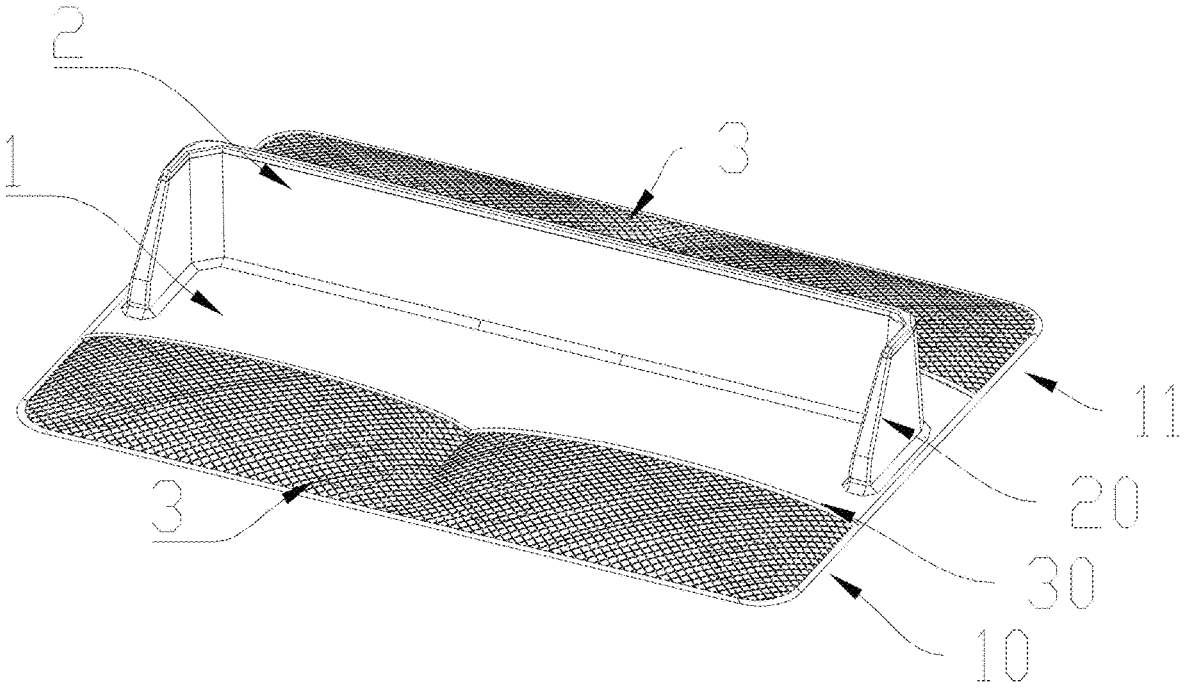
FIG. 1 is a schematic view of a bathtub functional pad in accordance with an embodiment of the present disclosure.

The element labels according to the embodiment of the present disclosure shown as below:

1 main body, 10 front portion, 11 back portion, 12 middle of upper surface, 13 middle of lower surface, 14 peripheral edge, 15 foldable portion, baffle, 20 wing portion, 21 chamber, 210 front wall, 211 back wall, 22 reinforcing rib, 23 top, 3 receiving bag, 30 mouth, 31 grid layer, 32 cloth belt, 4 sucking disc.

DETAILED DESCRIPTION

In order to more clearly understand the technical solution hereinafter in embodiments of the present disclosure, reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples.

According to the described embodiment of the present disclosure, all other embodiments obtained by one of ordinary skill in the related art without the need for a creative labor are within the protection scope of the present disclosure. Unless defined otherwise, the technical terms or scientific terms used for the present disclosure shall be a general meaning commonly understood by those having ordinary skill in the related art to which the present disclosure is applied.

In the description of the present disclosure, it needs to be understood that the terms mentioned below: the terms such as "first" and "second" shown in the specification are only used to describe, but not indicated that the elements of the present disclosure is important or represented the amount of the elements. That is, the features limited by the terms of "first" and "second" may explicitly or implicitly include one or more features. Similar, in the description of the present disclosure, the meaning of the term "one", "a" and "the" don't indicate a quantitative limit, but indicate that it includes at least one unless it is specifically illustrated. Furthermore, the terms such as "include", "including", "comprising" and "comprise" and the like means that elements or items in front of such term is intended to cover the elements or objects appeared the list behind the term and its equivalent, without excluding other elements or items. In the description of the present disclosure, except where specifically otherwise illustrated or limited, the terms "install", "connect", "link" and "fix" used herein should be understood in a broad perceive. Such as, the meaning may be tight connection, removable connection, or integrated connection. The meaning may also be mechanical connection, electrical connection, direct connection or indirect connection through intermediaries, or internal connection within two elements. The meaning of the terms used herein may be understood by one of ordinary skill in the related art according to specific conditions of the present disclosure. In addition, the terms such as "upper", "below", "left", and "right", etc, are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

Figure 2:
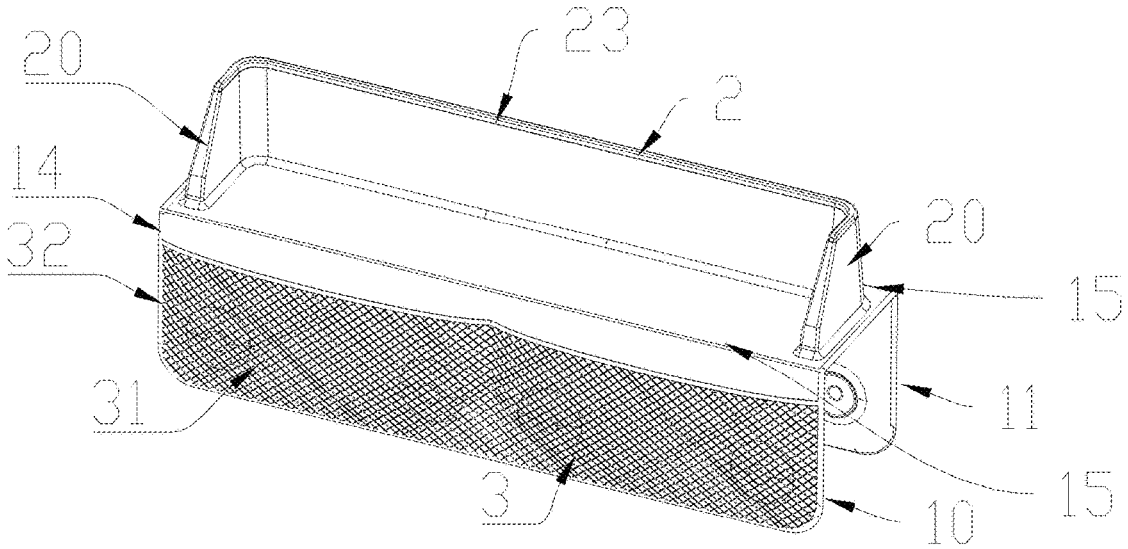
FIG. 2 is a schematic view of the bathtub functional pad of FIG. 1, but shown the bathtub functional pad in a usage state.

Referring to FIG. 1 and FIG. 2, a bathtub functional pad according to an embodiment of the present disclosure includes a main body 1 that can be bent and deformed, a baffle 2 arranged in a middle of an upper surface 12 of the main body 1, a bottom of the baffle 2 connected to the main body 1, a top 23 of the baffle 2 extending upwardly along a direction away from the main body 1, and at least one receiving bag 3 with a mouth 30 arranged on the main body 1 so as to take and place articles into the receiving bag 3 from the mouth 30.

When the functional pad of the present disclosure is in usage, the functional pad can be hung on an edge of the bathtub, a middle of a lower surface 13 of the main body 1 is in contact with an upper surface of the bathtub edge, the front portion 10 and the back portion 11 of the main body 1 that are respectively arranged on two sides of the baffle 2 are sagged downwards. The receiving bag 3 arranged on the main body 1 can be used to place such as toiletries and toys etc., which is very convenient to take the toiletries and the toys from the mouth 30. In a certain usage scenario, a child is taking a bath in the bathtub, he takes out the toys from the receiving bag 3 and then puts the toys into a water tank to play. Parents help the child clean outside the bathtub. The toys can soothe the child's emotions and increase a fun of bathing in the bathtub. In this way, the child that bathes in the bathtub has a high cooperation, and the baffle 2 on the main body 1 can effectively prevent water from splashing out of the bathtub to wet the parents' clothes.

In some embodiments of the present disclosure, two ends of the baffle 2 are bent and extend forward to respectively form a wing portion 20 thereof. The wing portion 20 that is bent can strengthen an effect of blocking water that droplets on both sides of the baffle 2, and can also play a supporting role on the baffle plate 2, so that the baffle 2 is more stable to stand.

Each of the main body 1 and the baffle 2 is preferably made of silica gel. Both the main body 1 and the baffle 2 can be integrated into a mold. When the functional pad is placed on the edge of the bathtub, the main body 1 made of silica gel will generate an adsorption force with a smooth surface of the bathtub, which helps to stabilize the placement of the functional pad.

Figure 3:
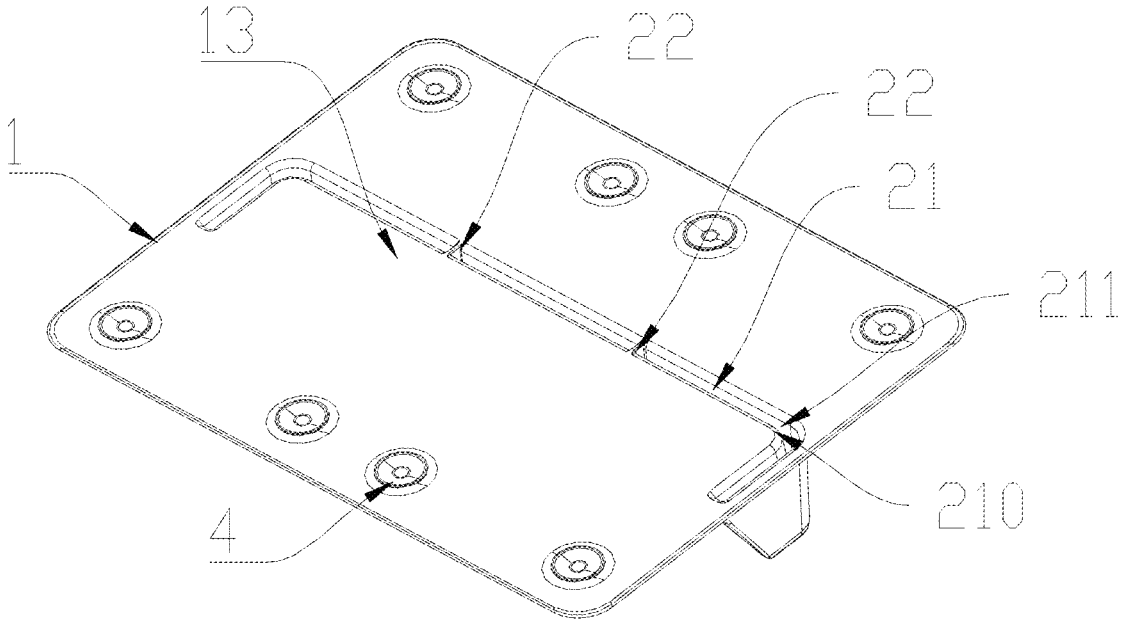
FIG. 3 is similar to FIG. 1, but shown from another view.

Referring to FIG. 3, in some embodiments of the present disclosure, an interior of the baffle 2 is hollowed to form a chamber 21 thereof, and an opening is formed in the middle of the lower surface 13 of the main body 1 to connect with the chamber 21. When the functional pad is in usage, the lower surface of the middle of the main body 1 is attached to the surface of the edge of the bathtub, that is, the opening of the chamber 21 inside the baffle 2 is adhered to the surface of the edge of the bathtub. The entire chamber 21 is equivalent to a sucking disc, so that the baffle 2 is properly squeezed to generate a negative pressure inside the chamber 21. A suction force between the opening of the chamber 21 and the bathtub is generated to enhance a placement stability of the functional pad.

Furthermore, a plurality of reinforcing ribs 22 is distributed in the chamber 21 and supported between a front wall 210 and a back wall 211 of the chamber 21. The plurality of reinforcing ribs 22 extends from bottom to top along the chamber 21, and two sides of each of the plurality of reinforcing ribs 22 are respectively connected with the front wall 210 and the back wall 211 of the chamber 21, thereby providing a support for the baffle 2 to avoid the baffle 2 from being collapsed.

In some embodiments of the present disclosure, a plurality of sucking discs 4 is arranged on the lower surface of the main body 1. For example, the plurality of sucking discs 4 is distributed along edges of the front portion 10 and the back portion 11 of the lower surface of the main body 1, when the functional pad is placed on the edge of the bathtub, the plurality of sucking discs 4 is adsorbed on an outer wall surface and an inner wall surface of the bathtub, so that the stability of the functional pad can be ensured.

The receiving bag 3 can be set only on the front portion 10 or the back portion 11 of the functional pad. When the functional pad is in usage, the front portion 10 faces the inside of the bathtub and the back portion 11 faces the outside of the bathtub, which can be selected according to the specific usage scenario. Preferably, the functional pad includes two receiving bags 3 respectively arranged at the front portion 10 and the back portion 11 of the upper surface of the main body 1. In an application scenario where parents take a bath for their children, the receiving bag 3 arranged at the front portion 10 can be used for holding toys, and the receiving bag 3 arranged at the back portion 11 can be used for holding toiletries.

In some embodiments of the present disclosure, a grid layer 31 is formed on each of the front portion 10 and the back portion 11 of the upper surface of the main body 1 to form the receiving bag 3; a cloth belt 32 is covered on a peripheral edge 14 of the main body 1, and the grid layer 31 is fixedly connected to the cloth belt 32. A plurality of lines is interlaced and woven into the grid layer, which is laid on the front portion 10 and the back portion 11 of the upper surface of the main body 1. Edge positions of the grid layer 31 are connected to the cloth belt 32 at the edge of the main body 1 and fixed to the main body 1 in a sewing mode. The side of the grid layer 31 facing the baffle 2 is not connected to the main body 1 to form the mouth 30. In the use process, the functional pad is inevitably in contact with water, an outer layer of the receiving bag 3 is the grid layer, so that water can flow out timely and prevent water from accumulating inside the receiving bag 3, and mold can be effectively avoided.

In some embodiments of the present disclosure, the at least one receiving bag 3 is divided into a plurality of individual pouches. Each receiving bag 3 is divided into a plurality of individual pouches, and the articles can be placed in different individual pouches in a classified mode, so that the articles can be conveniently taken.

In some embodiments of the present disclosure, a foldable portion 15 is arranged on each of a front side and a rear side of the baffle 2 to reduce a resistance when the front portion 10 and the back portion 11 of the main body 1 are bent. For example, a thickness of a corresponding position of the main body 1 can be reduced by setting grooves or other methods, so that the resistance of the main body 1 can be reduced when the main body 1 is bent, and the front portion 10 and the back portion 11 of the main body 1 can be more naturally attached to the outer wall and the inner wall of the bathtub.

To sum up, the functional pad of the present disclosure can be used in conjunction with the bathtub, and the receiving bag 3 can be used to place toys, toiletries and the like for conveniently being taken. After the toys or the toiletries is completely used, the toys or the toiletries can be placed in the receiving bag 3 for a next usage. The baffle 2 can effectively prevent water splashing out of the bathtub, reducing a situation where parents' clothes get wet.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A bathtub functional pad comprising:

a main body that can be bent and deformed, a baffle arranged in a middle of an upper surface of the main body, a bottom of the baffle connected to the main body, a top of the baffle extending upwardly along a direction away from the main body, and at least one receiving bag with a mouth arranged on the main body, wherein a grid layer is formed on each of a front portion and a back portion of the upper surface of the main body to form the at least one receiving bag; a cloth belt covered on a peripheral edge of the main body, and the grid layer fixedly connected to the cloth belt.

2. The bathtub functional pad as claimed in claim 1, wherein two ends of the baffle are bent and extend forward to respectively form a wing portion thereof.

3. The bathtub functional pad as claimed in claim 1, wherein each of the main body and the baffle is made of silica gel.

4. The bathtub functional pad as claimed in claim 3, wherein an interior of the baffle is hollowed to form a chamber thereof, and an opening is formed in the middle of a lower surface of the main body to connect with the chamber.

5. The bathtub functional pad as claimed in claim 4, wherein a plurality of reinforcing ribs is distributed in the chamber and supported between a front wall and a back wall of the chamber.

6. The bathtub functional pad as claimed in claim 3, wherein a plurality of sucking discs is arranged on a lower surface of the main body.

7. The bathtub functional pad as claimed in claim 1, wherein the at least one receiving bags that is arranged on the main body comprises two receiving bags, the two receiving bags respectively arranged at the front portion and the back portion of the upper surface of the main body.

8. The bathtub functional pad as claimed in claim 1, wherein the at least one receiving bag is divided into a plurality of individual pouches.

9. The bathtub functional pad as claimed in claim 1, wherein a foldable portion is arranged on each of a front side and a rear side of the baffle to reduce a resistance when the front portion and the back portion of the main body are bent.

10. A bathtub functional pad comprising:

a main body that can be bent and deformed, a baffle arranged in a middle of an upper surface of the main body, a bottom of the baffle connected to the main body, a top of the baffle extending upwardly along a direction away from the main body, and at least one receiving bag with a mouth arranged on the main body;

wherein each of the main body and the baffle is made of silica gel;

wherein an interior of the baffle is hollowed to form a chamber thereof, and an opening is formed in the middle of a lower surface of the main body to connect with the chamber; and wherein a plurality of reinforcing ribs is distributed in the chamber and supported between a front wall and a back wall of the chamber.

* * * * *